US008939529B2

(12) United States Patent
Shimada

(10) Patent No.: US 8,939,529 B2
(45) Date of Patent: Jan. 27, 2015

(54) IMAGE FORMING DEVICE AND METHOD OF IMAGE FORMING

(75) Inventor: Yoshitaka Shimada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 191 days.

(21) Appl. No.: 13/456,433

(22) Filed: Apr. 26, 2012

(65) Prior Publication Data

US 2012/0287184 A1 Nov. 15, 2012

(30) Foreign Application Priority Data

May 9, 2011 (JP) ..... 2011-104427

(51) Int. Cl.

| | |
|---|---|
| ***B41J 29/38*** | (2006.01) |
| ***B41J 2/01*** | (2006.01) |
| ***B41J 2/15*** | (2006.01) |
| ***B41J 3/00*** | (2006.01) |
| ***B41J 2/21*** | (2006.01) |
| ***B41J 11/00*** | (2006.01) |

(52) U.S. Cl.

CPC ..... *B41J 2/2117* (2013.01); *B41J 11/002* (2013.01)

USPC ..... 347/9; 347/12; 347/102; 347/101; 347/40; 347/4

(58) Field of Classification Search

USPC ..... 347/9, 102, 40, 4, 12, 101

See application file for complete search history.

(56) References Cited

U.S. PATENT DOCUMENTS

| | | | | |
|---|---|---|---|---|
| 7,244,021 | B2 * | 7/2007 | Arai | 347/102 |
| 7,407,277 | B2 * | 8/2008 | Yoneyama | 347/102 |
| 2007/0188547 | A1 | 8/2007 | Kobayashi et al. | |
| 2010/0141724 | A1 * | 6/2010 | Nakajima | 347/102 |
| 2010/0302299 | A1 | 12/2010 | Kobayashi et al. | |
| 2011/0037800 | A1 | 2/2011 | Tanoue et al. | |

FOREIGN PATENT DOCUMENTS

| | | |
|---|---|---|
| JP | 2001-113691 | 4/2001 |
| JP | 2004-306591 | 4/2004 |
| JP | 2005-254560 | 9/2005 |
| JP | 2007-50555 | 1/2007 |
| JP | 2011-37178 | 2/2011 |
| JP | 2011-110818 | 9/2011 |
| WO | 2005-105452 | 11/2005 |

* cited by examiner

*Primary Examiner* — Sarah Al Hashimi
(74) *Attorney, Agent, or Firm* — Workman Nydegger

(57) ABSTRACT

An image forming device which includes a first nozzle group, a second nozzle group, and are arranged by being deviated from the first nozzle group to one side in a predetermined direction, a light irradiation unit which is extended at least in the predetermined direction, a control unit which repeats an ejection operation in which the photo-curable ink is ejected from the nozzle while moving the nozzle group and the light irradiation unit in a direction intersecting the predetermined direction, and a transport operation of the medium in a state where a non-ejection region where the ink is not ejected is provided between the first nozzle group and the second nozzle group in a predetermined direction, and overlappingly forms a main image using the first photo-curable ink, and a background image using the second photo-curable ink.

9 Claims, 8 Drawing Sheets

IMAGE FORMING DEVICE AND METHOD OF IMAGE FORMING

BACKGROUND

The entire disclosure of Japanese Patent Application No: 2011-104427, filed May 9, 2011, is expressly incorporated by reference herein in its entirety.

1. Technical Field

The present invention relates to an image forming device and a method of image forming.

2. Related Art

Among printers as image forming devices, there is a printer in which ink (UV ink) cured when irradiated with UV light is used. Among printers which eject the UV ink while the heads are moving, there is a printer provided with a UV irradiation light source at both end portions in the movement direction of the head (for example, refer to JP-A-2005-254560). Such a printer is able to immediately cure the UV ink which is landed on a medium.

However, there is a concern that the irradiation amount of the UV light which can be radiated to the UV ink on the medium in one movement operation (pass) of the head may be small, and the UV ink on the medium is not sufficiently cured in one pass. For this reason, when the upper image is overlappingly printed on an underlying image in a pass immediately after a pass printing the underlying image in a case where the main image and the background image are overlappingly printed with each other, the upper image is overlapped with the underlying image in a state of not being sufficiently cured.

SUMMARY

An advantage of some aspects of the invention is to provide an image forming device which can suppress curing defects of an underlying image.

According to an aspect of the invention, there is provided an image forming device which includes, (A) a first nozzle group in which nozzles which eject a first photo-curable ink are aligned in a predetermined direction, (B) a second nozzle group in which nozzles which eject a second photo-curable ink are aligned in the predetermined direction, and are arranged by being deviated from the first nozzle group on one side in the predetermined direction, (C) a light irradiation unit which cures the photo-curable ink by radiating light to the photo-curable ink, and is arranged by being extended at least in the predetermined direction, by being stretched to an end portion on one side of the second nozzle group from an end portion of the other side of the first nozzle group in the predetermined direction in the predetermined direction, (D) a control unit which causes an ejection operation in which the photo-curable ink is ejected from the nozzle while relatively moving the nozzle group and the light irradiation unit, and a medium in a movement direction which intersects the predetermined direction, and a transport operation which relatively moves the nozzle group and the light irradiation unit, and the medium in the predetermined direction to be repeatedly executed, and forms a main image which is formed using the first photo-curable ink, and a background image which is overlappingly formed using the second photo-curable ink, in a state where a non-ejection area in which ink is not ejected is provided between the first nozzle group and the second nozzle group in the predetermined direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
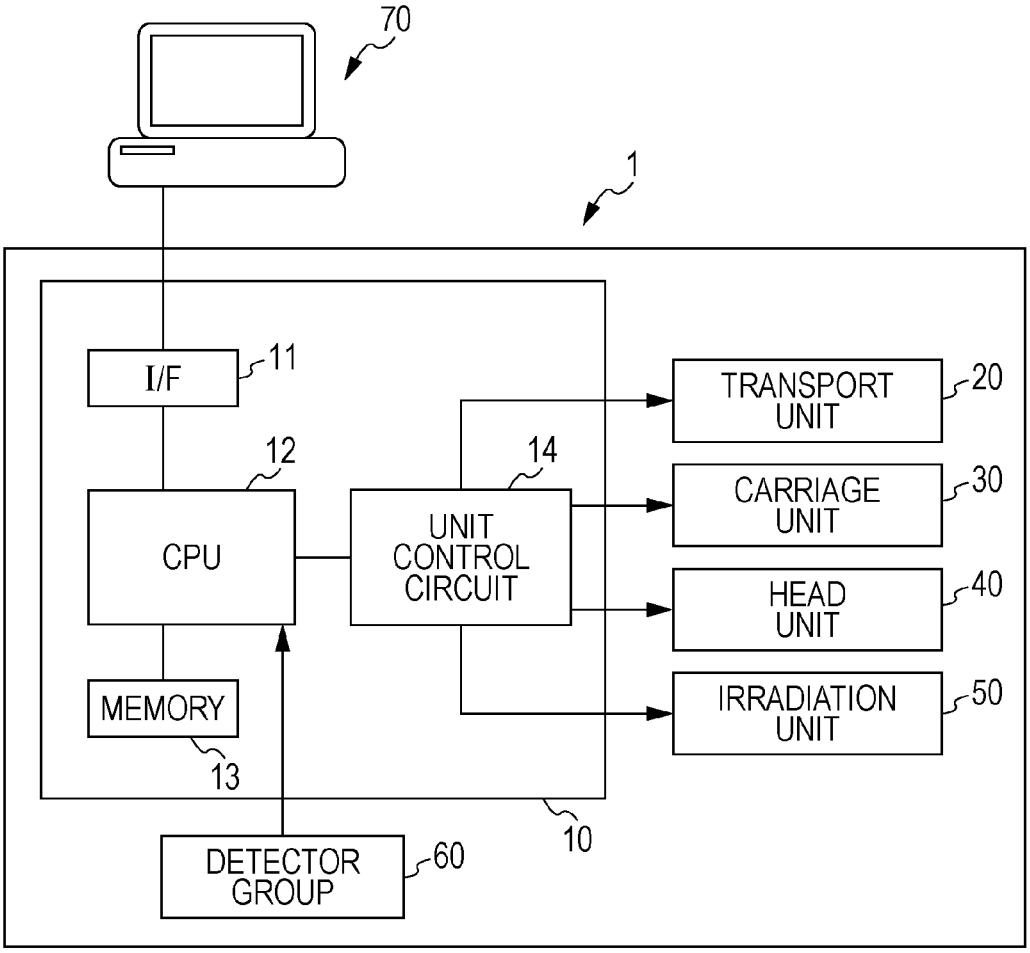
FIG. 1 is a block diagram which shows the entire configuration of a printer.

At least the following will be clarified according to the descriptions of the specification, and accompanying drawings.

That is, there is provided an image forming device which includes, (A) a first nozzle group in which nozzles which eject first photo-curable ink are aligned in a predetermined direction, (B) a second nozzle group in which nozzles which eject a second photo-curable ink are aligned in the predetermined direction, and are arranged by being deviated from the first nozzle group on one side in the predetermined direction, (C) a light irradiation unit which cures the photo-curable ink by radiating light to the photo-curable ink, and is arranged by being extended at least in the predetermined direction, by being stretched to an end portion on one side of the second nozzle group from an end portion of the other side of the first nozzle group in the predetermined direction in the predetermined direction, (D) a control unit which causes an ejection operation in which the photo-curable ink is ejected from the nozzle while relatively moving the nozzle group and the light irradiation unit, and a medium in a movement direction which intersects the predetermined direction, and a transport operation which relatively moves the nozzle group and the light irradiation unit, and the medium in the predetermined direction to be repeatedly executed, and forms a main image which is formed using the first photo-curable ink, and a background image which is overlappingly formed using the second photo-curable ink, in a state where a non-ejection area in which ink is not ejected is provided between the first nozzle group and the second nozzle group in the predetermined direction.

According to such an image forming device, it is possible to suppress a defective curing of an underlying image, and to overlap the upper image with the underlying image in a state of being sufficiently cured, accordingly, an image quality may be prevented from being deteriorated.

In the image forming device, dot columns which configure the main image, and are aligned along the movement direction are formed by the plurality of ejection operations including the transport operation therebetween, and forms dot columns which configure the background image, and are aligned along the movement direction are formed by the plurality of ejection operations including the transport operation therebetween.

According to such an image forming device, color unevenness of an image due to a difference in curing degree between a portion of the underlying image which is formed by the previous ejection operation and a portion of the underlying image which is formed by the latter ejection operation may be suppressed.

In the image forming device, the ratio of the length of the non-ejection area in the predetermined direction to the length of the first nozzle group in the predetermined direction, and the ratio of the length of the non-ejection area in the predetermined direction to the length of the second nozzle group in the predetermined direction are changeable.

According to such an image forming device, an image forming time may be shortened while suppressing the defective curing of the underlying image.

In the image forming device, when the ratio is a second value which is smaller than a first value compared to a case where the ratio is the first value, the irradiation intensity of light from the light irradiation unit is strong.

According to such an image forming device, the image forming time may be shorten while suppressing the defective curing of the underlying image.

In the image forming device, the length of the first nozzle group in the predetermined direction, the length of the second nozzle group in the predetermined direction, and the length of the non-ejection area in the predetermined direction are the length of integral multiple of a relative movement amount of the nozzle group, the light irradiation unit, and the medium in the predetermined direction in the transport operation.

According to such an image forming device, the number of nozzles forming dot columns which configure each image may be set to be constant, and a time for irradiating the underlying image with light after forming the underlying image may be set to be constant.

According to another aspect of the invention, there is provided a method of image forming which forms an image on a medium using an image forming device which includes, (A) a first nozzle group in which nozzles which eject a first photo-curable ink are aligned in a predetermined direction, (B) a second nozzle group in which nozzles which eject a second photo-curable ink are aligned in the predetermined direction, and are arranged by being deviated from the first nozzle group on one side in the predetermined direction, (C) a light irradiation unit which cures the photo-curable ink by radiating light to the photo-curable ink, and is arranged by being extended at least in the predetermined direction, by being stretched to an end portion on one side of the second nozzle group from an end portion of the other side of the first nozzle group in the predetermined direction in the predetermined direction, (D) a control unit which causes an ejection operation in which the photo-curable ink is ejected from the nozzle while relatively moving the nozzle group and the light irradiation unit, and a medium in a movement direction which intersects the predetermined direction, and a transport operation which relatively moves the nozzle group and the light irradiation unit, and the medium in the predetermined direction to be repeatedly executed, and forms a main image which is formed using the first photo-curable ink, and a background image which is overlappingly formed using the second photo-curable ink, in a state where a non-ejection area in which ink is not ejected is provided between the first nozzle group and the second nozzle group in the predetermined direction.

According to such an image forming device, it is possible to suppress a defective curing of an underlying image, and to overlap the upper image with the underlying image in a state of being sufficiently cured, accordingly, an image quality may be prevented from being deteriorated.

Printing System

Embodiments of the invention will be described by assuming an image forming device as an ink jet printer (hereinafter, referred to as a printer), and by exemplifying a printing system in which the printer and a computer are connected to each other.

Figure 2A:
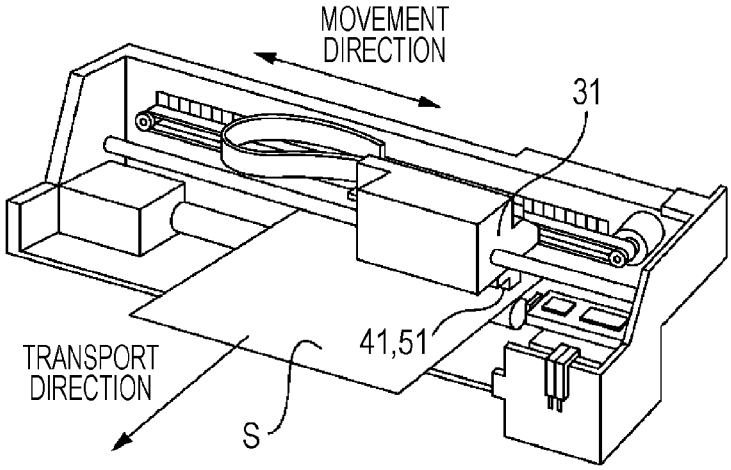
FIG. 2A is a schematic perspective view of the printer.
Figure 2B:
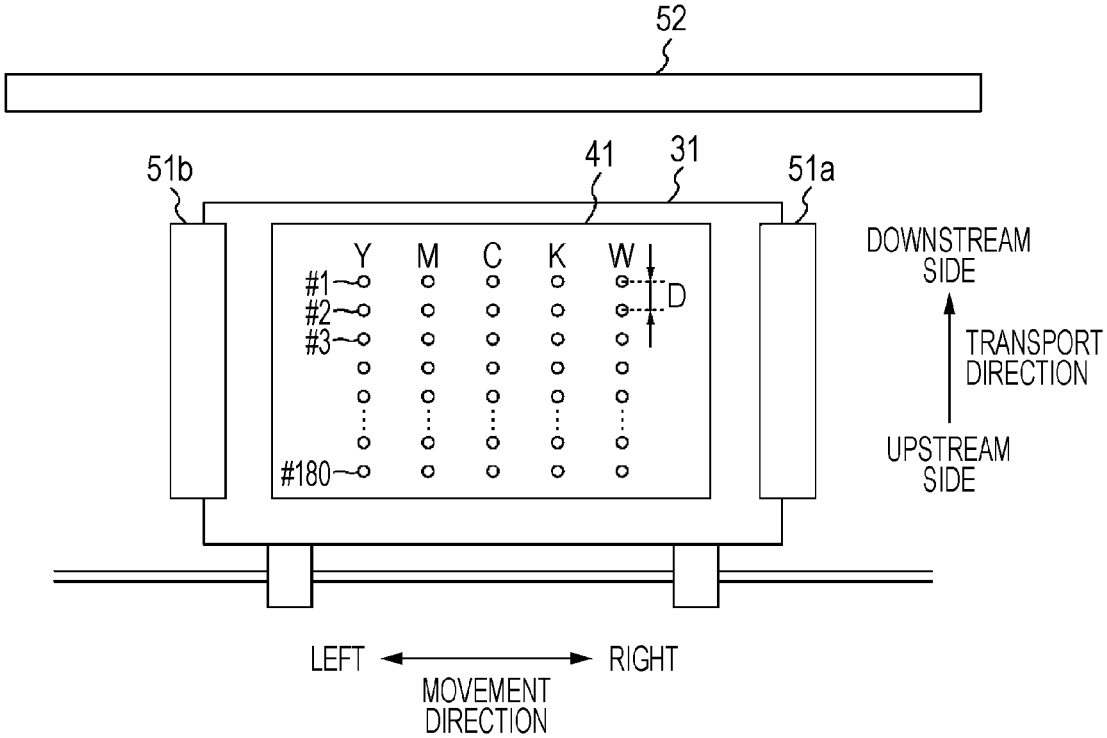
FIG. 2B is a diagram which describes the periphery of a carriage.

FIG. 1 is a block diagram which shows the entire configuration of a printer 1, FIG. 2A is a schematic perspective view of the printer 1, and FIG. 2B is a diagram which describes a periphery of a carriage 31. In addition, in FIG. 2B, an arrangement of nozzles which is shown from the top of a head 41 is virtually shown.

The printer 1 according to the embodiment performs printing of an image on a medium S (for example, a sheet, a cloth, or a film), by ejecting UV-curable ink which is cured by an irradiation of UV light. In addition, the UV-curable ink (hereinafter, referred to as UV ink) is ink including UV curable resin, and is cured by a photo-polymerization reaction which occurs in the UV curable resin when irradiated with the UV light.

A computer 70 is communicably connected to the printer 1, and outputs printing data for printing an image in the printer 1 to the printer 1.

A controller 10 is a control unit for controlling the printer 1. An interface unit 11 is a unit for performing transmission and reception of the data between the computer 70 and the printer 1. A CPU 12 is an arithmetic processing unit for performing the entire control of the printer 1. A memory 13 is a memory for securing an area for storing a program of the CPU 12, a working area, or the like. The CPU 12 controls each unit by a unit control circuit 14. In addition, a detector group 60 monitors the status in the printer 1, and the controller 10 controls each unit on the basis of the detection result.

A transport unit 20 is a unit for sending the medium S at a position to be printed, and transporting the medium S in the transport direction with a predetermined transport amount when performing the printing.

A carriage unit 30 is a unit for moving the head 41 which is mounted to the carriage 31, or the like to the movement direction which intersects the transport direction.

A head unit 40 is a unit for ejecting ink on the medium S, and has the head 41. As shown in FIG. 2B, a plurality of nozzle columns in which nozzles which eject ink are aligned in the transport direction every predetermined gap (nozzle pitch D) is formed at the bottom face of the head 41. For descriptions, a small number (Nos. 1, 2, . . . ) is attached in order from nozzles on the downstream side in the transport direction, among nozzles which belong to the nozzle column.

The printer 1 according to the embodiment is able to eject five colors of ink (YMCK and W), and the head 41 is formed with a yellow nozzle column Y which ejects yellow ink, a magenta nozzle column M which ejects magenta ink, a cyan nozzle column C which ejects cyan ink, a black nozzle column K which ejects black ink, and a white nozzle column W which ejects white ink.

In addition, the nozzles are communicated with an ink chamber which is filled with ink, and the ink ejection method from the nozzle may be a piezoelectric method in which ink is ejected from the nozzle by expanding and contracting the ink chamber by applying a voltage to a driving element (piezoelectric element), or a thermal method in which ink is ejected from the nozzle by bubbles which are generated in the nozzle using a heating element.

In such a printer 1, an ejection operation in which ink is ejected from the nozzle while the head 41 is moving in the movement direction, and a transport operation in which the medium S is transported in the transport direction are repeated. As a result, it is possible to print a two-dimensional image on the medium S, since dots are formed by the latter ejection operation at a position on the medium S which is different from a dot position formed by the previous ejection operation. Hereinafter, the one ejection operation by the head 41 is referred to as a "pass".

An irradiation unit 50 is a unit for irradiating UV ink which is landed on the medium S with UV light, and curing the UV ink, and has a provisional irradiation unit 51, and a main irradiation unit 52. In addition, as a light source of the UV light irradiation, for example, Light Emitting Diode (LED), a metal-halide lamp, a mercury lamp, or the like are exemplified. Further, an irradiation amount of the UV light per unit area by the irradiation unit (irradiation energy ($mJ/cm^2$)) is set by a product of the irradiation intensity of the UV light ($mW/cm^2$) and the irradiation time (s).

As shown in FIG. 2B, the provisional irradiation units 51*a* and 51*b* are provided at both end portions in the movement direction of the carriage 31, and the provisional irradiation units move in the movement direction together with the head 41 along with the movement of the carriage 31. In addition, positions of the provisional irradiation units 51*a* and 51*b*, and the nozzle columns in the transport direction are the same as each other, and the length of the provisional irradiation units 51*a* and 51*b* in the transport direction is equal to or longer than the length of the nozzle columns in the transport direction. Accordingly, the UV ink which is ejected from the head 41 during the movement in the movement direction is irradiated with the UV light by the second provisional irradiation units 51*a* and 51*b* immediately after landing on the medium S.

The UV ink which is ejected from the head 41 is irradiated with the UV light by the first provisional irradiation unit 51*a* which is positioned on the right side in the movement direction, at the time of an outward movement in which the carriage 31 moves to the left in the movement direction. On the contrary, at the time of a return movement in which the carriage 31 moves to the right in the movement direction, the UV ink which is ejected from the head 41 is irradiated with the UV light by the second provisional irradiation unit 51*b* which is positioned on the left side in the movement direction.

The main irradiation unit 52 is provided on the downstream side of the carriage 31 in the transport direction by being fixed. The length of the main irradiation unit 52 in the movement direction is equal to longer than that of the medium S in the movement direction, and the UV ink on the medium S which passes through under the main irradiation unit 52 is irradiated with the UV light. Accordingly, the UV ink on the medium S is completely cured by the main irradiation unit 52, and an image using the UV ink is completed.

Printing Mode

Figure 3:
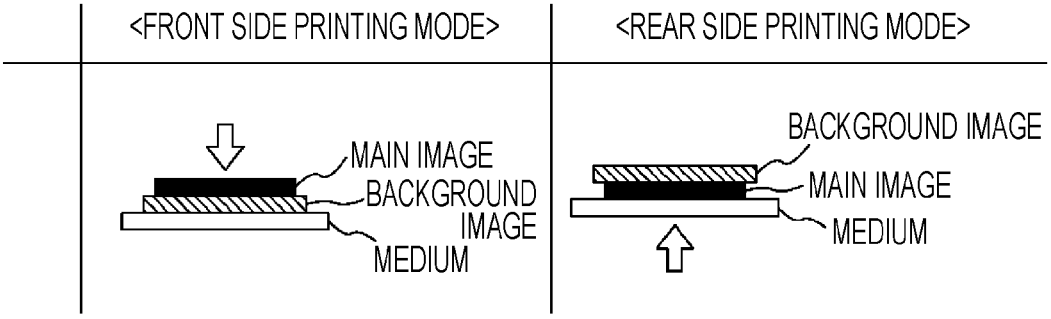
FIG. 3 is a diagram which describes a printing mode of the printer.

FIG. 3 is a diagram which describes a printing mode of the printer 1. There is a case where a background image which is printed using white ink (W) is overlappingly printed on the main image (a color image or a monochrome image) which is printed using four colors of ink (YMCK). In that case, for example, it is possible to make the color developing property of the main image good when the medium is not white, or to prevent the opposite side of the main image from being seen through when the medium is transparent.

When the main image is overlappingly printed with the background image, the printer 1 performs printing using any one of a "front side printing mode" and a "rear side printing mode". The front side printing mode is a mode in which the main image is printed so as to be seen from the printing surface side, and in which the background image is firstly printed with respect to a predetermined region of the medium, and the main image is printed on the background image. The rear side printing mode is a mode in which the main image is seen through the medium, and in which the main image is firstly printed with respect to a predetermined region of the medium, and the background image is printed on the main image.

Printing Method of Comparative Example

Figure 4A:
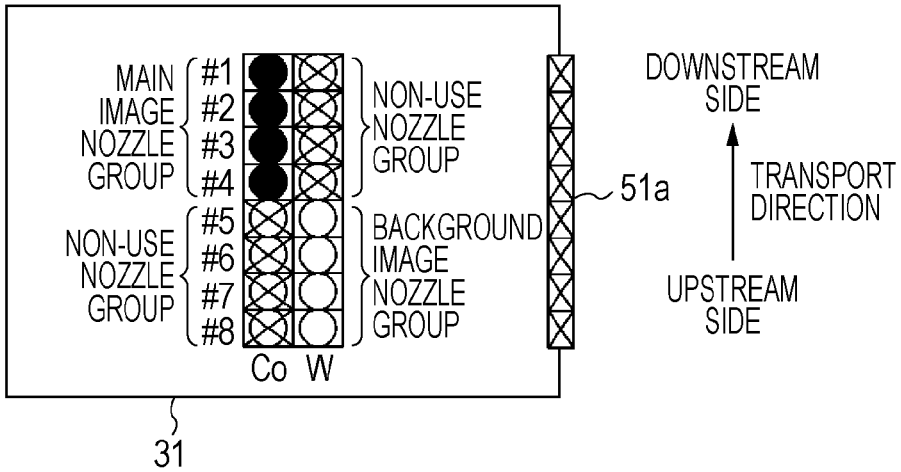
FIG. 4A is a diagram which describes nozzles used in a printing method of a comparative example.
Figure 4B:
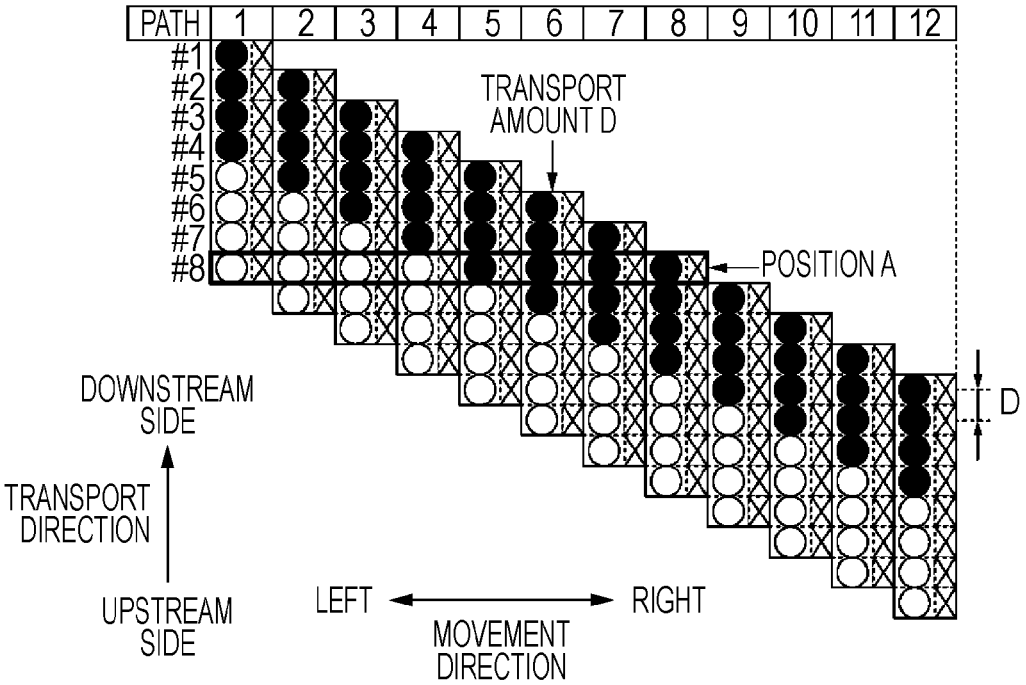
FIG. 4B is a diagram which describes a printing method of the comparative example.

FIG. 4A is a diagram which describes nozzles used in a printing method of a comparative example, and FIG. 4B is a diagram which describes a printing method of the comparative example. Hereinafter, the "front side printing mode" in which the main image is overlapped on the background image will be described as an example with respect to the printing method of the comparative example in which the main image and the background image are overlappingly printed. In the figure, the number of nozzles which belong to one nozzle column is reduced (Nos. 1 to 8), and the nozzle columns which respectively eject four colors of ink (YMCK) are collectively denoted by "color nozzle column Co".

In addition, for easy descriptions, a printing method (a so-called unidirectional printing) is exemplified in which the head 41 ejects ink only when the carriage 31 moves to the left in the movement direction (outward movement). In addition, it is set such that only the first provisional irradiation unit 51*a* which is provided on the side opposite (right side) to the side where the head 41 moves radiates the UV light, and the second irradiation unit 51*b* (not shown) which is provided on the side (left side) where the head 41 moves does not radiate the UV light.

In the front side printing mode in the comparative example, it is set such that a half the nozzle groups (Nos. 1 to 4) on the downstream side in the transport direction among the nozzles (Nos. 1 to 8) which belong to the white nozzle column W are non-use nozzle groups, and a half the nozzle groups (Nos. 5 to 8) on the upstream side in the transport direction are nozzle groups (nozzle groups for background image) which are used for printing the background image. On the other hand, a half the nozzle groups (Nos. 1 to 4) on the downstream side in the transport direction among the nozzles (Nos. 1 to 8) which belong to the color nozzle column Co are nozzle groups used for printing the main image (nozzle groups for main image), and a half the nozzle groups (Nos. 5 to 8) on the downstream side in the transport direction are the non-use nozzle groups.

Here, the main image and the background image are printed using nozzles which are different from each other in four passes. That is, dot columns (hereinafter referred to as raster lines) which configure each image, and are formed along the movement direction are completed by the nozzles which are different from each other in four passes. In addition, the dots are formed in a pixel region of ¼ among the pixel region aligning in the movement direction (unit area which is defined on the medium according to a printing resolution), and the dots are formed in the entire pixel region which aligns in the movement direction by the four passes.

For the reason, as shown in FIG. 4B, the transport amount of the medium of one time is set to a nozzle pitch D. That is, the printer 1 alternately repeats an ejection operation by the main image nozzle group and the background image nozzle group, and a transport operation which transports the medium by the transport amount D on the downstream side in the transport direction. In addition, in FIG. 4B, the main image nozzle group (●) and the background image nozzle group (○) are shown in one nozzle column. In addition, the medium is transported on the downstream side in the transport direction with respect to the head 41 in practice, however, in FIG. 4B, the head 41 is shown by being deviated on the upstream side in the transport direction in order to show the relative positional relationship of the head 41 in each pass.

As a result, in pass 1, the position A on the medium in the transport direction faces a background image nozzle group (No. 8 in W), white ink is ejected to the position A, and the first irradiation unit 51*a* radiates the UV light to the white ink which is landed on the position A. Even in the passes 2 to 4 thereafter, the position A faces the background image nozzle groups (Nos. 5 to 7 in W), the white ink is ejected to the position A, and the white ink is irradiated with the UV light. That is, a part of the background image (raster lines configuring the background image) is printed in the passes 1 to 4 in the position A on the medium.

Thereafter, in the fifth pass subsequent to the fourth pass after ending of printing of the background image, the position A on the medium faces the main image nozzle group (No. 4 in Co), four colors of ink (YMCK) is ejected on the background image of the position A, and the four colors of ink is irradiated with the UV light. Even in the passes 6 to 8 thereafter, the position A faces the main image nozzle groups (Nos. 1 to 3 in Co), the four colors of ink is ejected to the position A, and the four colors of ink is irradiated with the UV light. That is, a part of the main image (raster lines configuring the main image) is printed in the passes 5 to 8 on a part of the background image which is already printed at the position A on the medium, and an image is overlappingly printed in order according to the front side printing mode.

In addition, on the contrary, in the rear side printing mode (not shown), a half nozzle group (Nos. 1 to 4) on the downstream side of the white nozzle column W in the transport direction are set to the background image nozzle group, and a half nozzle group (Nos. 5 to 8) on the upstream side of the color nozzle column Co in the transport direction are set to the main image nozzle group.

In this manner, when the main image and the background image are overlappingly printed, the nozzle group for the image which is previously printed (underlying image) is set to the nozzle group which is arranged by being deviated from the nozzle group for the image which is printed in the latter (the upper image) on the upstream side in the transport direction. By doing that, since the predetermined region of the medium faces the underlying image nozzle group earlier than the upper image nozzle group, it is possible to print the upper image on the underlying image overlappingly in the different pass.

However, in the printing method in the comparative example, the nozzle group on the immediate downstream side of the underlying image nozzle groups (Nos. 5 to 8 in W in background image nozzle groups in FIG. 4A) are set to the upper image nozzle groups (Nos. 1 to 4 in Co in the main image nozzle groups in FIG. 4A). That is, the gap between the underlying image nozzle group and the upper image nozzle groups in the transport direction is set to be equal to the nozzle pitch D, and the transport amount D of the medium. For this reason, the upper image is overlappingly printed on the underlying image in the next pass of the pass at which the printing of the underlying image with respect to a predetermined region of the medium is completed.

That is, in the printing method of the comparative example, another pass is not included between a pass at which the printing of the underlying image is completed with respect to a predetermined region of the medium and a pass at which the printing of the upper image is started, and the time gap of printing the underlying image and the upper image is short.

Meanwhile, the provisional irradiation unit 51*a* which is provided at the carriage 31 radiates the UV light to the UV ink on the medium while moving in the movement direction. For this reason, the time during which the provisional irradiation unit 51*a* radiates the UV light to the UV ink on the medium in one pass is short, and the irradiation amount of the UV light (irradiation energy) which can be radiated to the UV ink on the medium in one pass by the provisional irradiation unit 51*a* is small. Accordingly, the UV ink on the medium is not sufficiently cured with the irradiation amount of the UV light which is radiated from the provisional irradiation unit 51*a* in one pass.

For this reason, as in the printing method of the comparative example, in the printing method in which the upper image is overlappingly printed in the next pass of a pass at which the printing of the underlying image is completed, there is a concern that the upper image may be overlappingly printed in a state where the underlying image is insufficiently cured. Specifically, when the underlying image in a predetermined region on the medium is printed in a plurality of passes, a portion of the underlying image which is printed in the last pass is overlapped with the upper image in a state of not being irradiated with the UV light by the provisional irradiation unit 51*a*.

For example, in the printing method shown in FIG. 4B, a portion of the background image which is printed in pass 1 at the position A on the medium is irradiated with the UV light in four passes 1 to 4 by the provisional irradiation unit 51*a*, however, a portion of the background image which is printed in pass 4 at the position A on the medium is irradiated with the UV light only once in pass 4, by the provisional irradiation unit 51*a*. For this reason, the portion on the background image which is printed in pass 4 is overlapped with the upper image, specifically, in a state where the curing degree is low.

When the upper image is overlappingly printed in a state where the curing of the underlying image is not sufficient, there are problems of, for example, peeling of the image, aggregation or spreading of ink, or the like. Alternatively, there is a problem in that the upper image is buried in the underlying image, accordingly, it is difficult to print two images overlapppingly. In addition, when the underlying image is printed in a plurality of passes, the number of the passes which are irradiated with the UV light by the provisional irradiation unit 51*a* is different between a portion of the background image which is printed in the previous pass and a portion of the background image which is printed in the latter pass, accordingly, the curing degree becomes different. As a result, color unevenness occurs in the image. That is, as in the printing method of the comparative example, the image quality is deteriorated when the upper image is overlappingly printed in a state where the curing of the underlying image is not sufficient.

Printing Method of Embodiment

First Embodiment

Figure 5A:
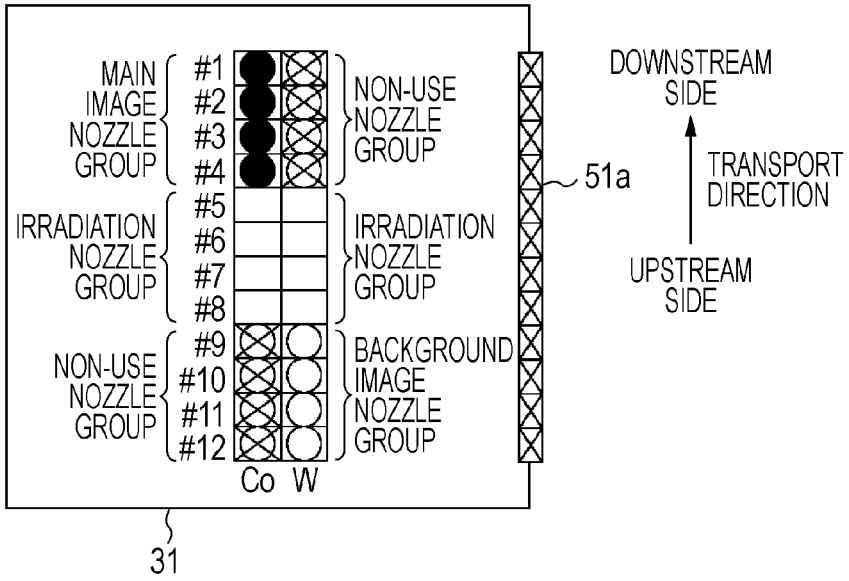
FIG. 5A is a diagram which describes nozzles used in a printing method of a first embodiment.
Figure 5B:
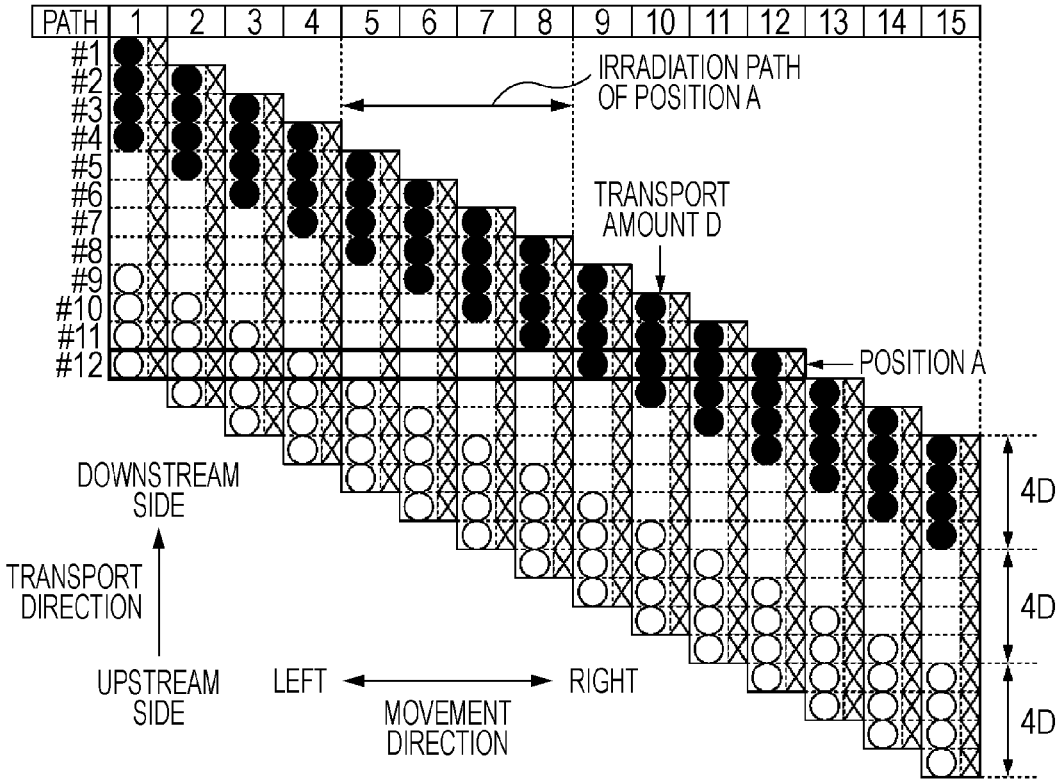
FIG. 5B is a diagram which describes a printing method of the first embodiment.

FIG. 5A is a diagram which describes nozzles used in a printing method according to the embodiment (first embodiment), and FIG. 5B is a diagram which describes the printing method according to the embodiment (first embodiment). Hereinafter, the printing method according to the embodiment in which a main image and a background image are overlappingly printed will be described by exemplifying the front side printing mode.

For easy descriptions, as in the printing method of the comparative example, it is set such that a head 41 ejects ink in an outward movement, and only a first provisional irradiation unit 51*a* radiates UV light. In addition, raster lines which respectively configure the main image and the background image are printed by different nozzles from each other in four passes, dots are formed in ¼ pixel regions which align in the movement direction in each pass, and the transport amount of a medium in one transport operation is set to a nozzle pitch D.

In addition, as shown in FIG. 5A, in the printing method according to the embodiment, nozzle groups (Nos. 1 to 4) of ⅓ on the downstream side in the transport direction among nozzles (Nos. 1 to 12) which belong to white nozzle columns W are set to non-use nozzle groups, nozzle groups (Nos. 9 to 12) of ⅓ on the upstream side in the transport direction are set to background image nozzle groups, and nozzle groups (Nos. 5 to 8) of ⅓ at the center in the transport direction are set to "irradiation nozzle groups". On the other hand, nozzle groups (Nos. 1 to 4) of ⅓ on the downstream side in the transport direction among nozzles (Nos. 1 to 12) which belong to color nozzle columns Co are set to the main image nozzle group, nozzle groups (Nos. 9 to 12) of ⅓ on the upstream side in the transport direction are set to non-use nozzle groups, and nozzle groups (Nos. 5 to 8) of ⅓ at the center in the transport direction are set to "irradiation nozzle groups".

The "irradiation nozzle groups" are nozzle groups which do not eject ink on the medium, similarly to the non-use nozzle groups. However, since the non-use nozzle groups are aligned in the movement direction with the nozzle groups which print the image (main image nozzle groups, or background image nozzle groups), ink is ejected to a portion of the medium which faces the non-use nozzle groups in a certain pass. On the other hand, positions in the transport direction of each irradiation nozzle group of the white nozzle column W and the color nozzle column Co are the same as each other, and the irradiation nozzle groups are aligned in the movement direction. Accordingly, ink is not ejected to a portion of the medium which faces the irradiation nozzle groups in a certain pass, the ink is not ejected, and only the UV light is radiated by the provisional irradiation units 51*a* and 51*b*. That is, the irradiation nozzle groups are nozzle groups for providing dedicated irradiation passes in which the provisional irradiation units 51*a* and 51*b* irradiate the UV ink which has already landed on a portion of the medium which is facing with the UV light.

In such a nozzle setting, the printer 1 alternately repeats an ejection operation by the main image nozzle groups and the background image nozzle groups, and a transport operation which transports the medium by the transport amount D on the downstream side in the transport direction. As a result, printing is performed as shown in FIG. 5B.

The position A on the medium in the transport direction firstly faces the background nozzle groups (Nos. 9 to 12 in W) in passes 1 to 4, white ink is ejected to the position A, and the first irradiation unit 51*a* irradiates the UV ink which has landed on the position A with the UV light. That is, a part of the background image (raster lines configuring the background image) is printed at the position A in the passes 1 to 4.

Thereafter, since the position A on the medium faces the irradiation nozzle groups (Nos. 5 to 8 in W and Co) in the passes 5 to 8, ink is not ejected to the position A, and only the first irradiation unit 51*a* irradiates the white ink which has landed on the position A with the UV light. Accordingly, a part of the background image which is printed at the position A in the passes 1 to 4 is sufficiently cured by the UV light which is radiated by the first irradiation unit 51*a* in the passes 5 to 8 without being immediately overlapped with the main image in the pass 5.

Thereafter, the position A on the medium faces the main image nozzle groups (Nos. 1 to 4 in Co) in the passes 9 to 12, four colors of ink is ejected on the background image of the position A, and the first irradiation unit 51*a* irradiates the four ink landed on the position A with the UV light. That is, in the passes 9 to 12, a part of the main image (raster lines configuring the main image) is overlappingly printed on a part of the background image of the position A which has sufficiently cured in the passes 5 to 8.

In addition, on the contrary, in the rear side printing mode (not shown), the nozzle groups (Nos. 1 to 4) of ⅓ on the downstream side of the white nozzle column W in the transport direction are set to the background image nozzle groups, the nozzle groups (Nos. 9 to 12) of ⅓ on the upstream side of the color nozzle column Co in the transport direction are set to the main image nozzle groups, and the nozzle groups (Nos. 5 to 8) of ⅓ at the center of each nozzle column W and Co in the transport direction are set to the irradiation nozzle groups. In this case, since a predetermined region of the medium faces the irradiation nozzle groups after the main image is printed on the predetermined region of the medium, it is possible to print the background image on the main image in a state where the main image is sufficiently cured by the provisional unit 51*a*.

According to the embodiment, when the main image and the background image are overlappingly printed in this manner, the controller 10 (control unit) of the printer 1 sets a part of the color nozzle columns Co in which the nozzle ejects four colors of ink (first photo-curable ink) align in the transport direction (predetermined direction) to the "main image nozzle groups (first nozzle groups)", and sets the nozzle groups as a part of the white nozzle columns W in which the nozzles ejecting white ink (second photo-curable ink) are aligned in the transport direction, and are arranged by being deviated from the main image nozzle groups to one side in the transport direction to the "background image nozzle groups (second nozzle groups)". At this time, the controller 10 sets the image nozzle groups which form any one of the main image and the background image first on a predetermined region of the medium to the nozzle groups which are arranged by being deviated from the image nozzle groups which are formed later on the upstream side in the transport direction.

In addition, the controller 10 provides the "irradiation nozzle groups" which do not eject ink between the main image nozzle groups and the background image nozzle groups in the transport direction with respect to each of nozzle column W and Co. That is, the controller 10 causes the main image and the background image to be overlappingly printed by causing the ejection operation for ejecting ink from nozzles while moving the nozzle columns W and Co, and the provisional irradiation units 51*a* and 51*b* in the movement direction, and the transport operation of the medium to be repeatedly executed, in a state where the "non-ejection region (region where irradiation nozzle groups are positioned)" is provided, which does not eject ink between the main image nozzle groups and the background image nozzle groups in the transport direction.

In addition, when the background image nozzle groups are deviated from the main image nozzle groups to one side in the transport direction, the provisional irradiation units 51*a* and 51*b* (light irradiation unit) are to be extended at least in the transport direction by being stretched to the end portion on one side of the background image nozzle group in the transport direction from the end portion on the other side of the main image nozzle group in the transport direction. That is, the provisional irradiation units 51*a* and 51*b* are present at a position equal to the position of the irradiation nozzle groups in the transport direction.

In this manner, it is possible to print the main image and the background image overlappingly in the order according to the printing mode in different passes from each other, and to make a predetermined region (underlying image) on the medium and the irradiation nozzle group (non-ejection region) to face each other, not making the predetermined region on the medium and the nozzle group printing the upper image face each other. That is, it is possible to provide passes only for radiating the UV light by the provisional irradiation units 51*a* and 51*b*, without ejecting ink between ending of the printing of the underlying image with respect to a predetermined region on the medium and the overlapping printing of the upper image.

That is, compared to the printing method (FIGS. 4A and 4B) of the comparative example, according to the printing method (FIGS. 5A and 5B) of the embodiment, it is possible to make time of radiating the UV light to the underlying image before overlapping the upper image long (it is possible to provide the passes only for radiating the UV light by the provisional irradiation units 51*a* and 51*b*), and to print the upper image overlappingly in a state where the underlying image is sufficiently cured. As a result, according to the embodiment, it is possible to suppress occurrences of problems such as peeling of the image, aggregation or spreading of ink, or a problem in which the upper image is buried in the underlying image, and to prevent the image quality from deteriorating.

In addition, according to the embodiment, the raster line for configuring the main image and the raster line for configuring the background image are formed by a plurality of passes (ejection operations) including the transport operation therebetween. In this case, since the number of passes is different between the portion of the underlying image printed in the previous pass and a portion of the underlying image printed in the latter pass, color unevenness in the image due differences in the curing degree easily occurs. However, in the printing method according to the embodiment, even the portion of the underlying image printed in the latter pass is sufficiently cured by the provisional irradiation units 51*a* and 51*b*, since the medium faces the irradiation nozzle group after the printing of the underlying image. For this reason, it is possible to suppress color unevenness due differences in the curing degree between the portion of the underlying image printed in the previous pass and the portion of the underlying image printed in the latter pass.

In addition, when the raster lines which configure each image are printed using the plurality of passes, as the printing method according to the embodiment, it is more effective that the printing is performed by providing the irradiation nozzle groups between the main image nozzle groups and the background image nozzle groups. Further, it is possible to print the raster lines configuring each image with a plurality of different nozzles, and to suppress the deterioration of the image quality due to a defective nozzle.

In addition, in FIGS. 5A and 5B, the length of the main image nozzle groups and the background image nozzle groups in each transport direction (4D) is equal to the length of the irradiation nozzle groups in the transport direction (4-D). Further, the length of the main image nozzle groups and the background image nozzle groups in each transport direction (4D), and the length of the irradiation nozzle groups in the transport direction (4D) are set to the length of integral multiple (four times) of the medium transport amount (D) in one transport operation.

Assuming that the length of the main image nozzle groups and the background image nozzle groups, and the length of the irradiation nozzle groups in the transport direction (4D) in each transport direction are not the integral multiple of the medium transport amount (D), and, for example, and the medium transport amount is 3D. In this case, according to the position of the medium in the transport direction, the number of nozzles of each nozzle group facing the medium varies. As a result, for example, a raster line which is printed by two main image nozzles and a raster line which is printed by one main image nozzles are present in the main image, accordingly, color unevenness occurs in the main image, and the printing control becomes complicated, as well. In addition, time variation arises when irradiating the underlying image with the UV light, since a medium region facing two irradiation nozzles and a medium region facing one irradiation nozzle are present. Due to this, a region where the curing of the background image is insufficient is generated, or color unevenness occurs due to the difference in curing degree of the underlying image.

Therefore, as the embodiment (FIGS. 5A and 5B), the length of the main image nozzle groups in the transport direction, the length of the background image nozzle groups in the transport direction, and the length of the irradiation nozzle groups in the transport direction (4D) of the irradiation nozzle group (non-ejection region) are set to the length of integral multiple of the medium transport amount (D) in one transport operation. In addition, the length of the non-ejection region in the transport direction is the length in the transport direction from the end portion on the downstream side of the nozzle groups printing the underlying image in the transport direction to the end portion on the upstream side of the nozzle groups printing the upper image in the transport direction.

In this manner, it is possible to make the number of nozzles (number of passes) printing each of the raster lines configuring the main image and the raster lines configuring the background image be constant, to suppress color unevenness in the image, and to easily control the printing.

In addition, it is possible to make the number of passes in which the medium faces the irradiation nozzle groups be constant without depending on the position in the transport direction, and to make irradiation time of the UV light to the underlying image be constant between the ending of printing of the underlying image and the overlapping printing of the upper image. Accordingly, it is possible to sufficiently cure the underlying image all over the region, and to suppress color unevenness in the image.

Hitherto, for ease of description, unidirectional printing has been exemplified, however, it is not limited to this. A printing method in which the head 41 ejects ink anytime it moves to the left, or to the right in the movement direction (a so-called bidirectional printing) may be performed.

In addition, the two provisional irradiation units 51*a* and 51*b* may radiate the UV light at all times regardless of the direction in which the head 41 moves. By doing that, UV ink which has been ejected from the head 41 at a certain pass is not only irradiated with the UV light by the provisional irradiation unit 51 which is provided on the side opposite to a side where the head 41 moves, but also irradiated with the UV light in the pass by the provisional irradiation unit 51 which is provided at a side to which the head 41 moves before the head 41 newly ejects the UV ink in the subsequent pass. For this reason, it is possible to increase the irradiation amount of the UV light which is radiated to the underlying image, and to print the upper image overlapppingly in a state where the underlying image is further cured. Conversely, it is possible to reduce the number of nozzles belonging to the irradiation nozzle group, and to reduce the number of passes only for irradiating the underlying image with the UV light by the provisional irradiation units 51*a* and 51*b*, by causing the two provisional irradiation units 51*a* and 51*b* to radiate the UV light.

In addition, in FIG. 5A, the length of the provisional irradiation unit 51*a*, the length of the nozzle columns W and Co in the transport direction, and the position in the transport direction are set to be equal, however, it is not limited to this. For example, the provisional irradiation units 51*a* and 51*b* may be extended on the downstream side of the nozzle columns W and Co in the transport direction. In this case, when printing on a predetermined portion of the upper image is ended, then the portion of the upper image faces the provisional irradiation unit 51 which extends on the downstream side in the transport direction, and the portion of the upper image is irradiated with the UV light, accordingly, it is possible to sufficiently cure the portion of the upper image. However, in the printer 1 according to the embodiment (FIG. 2B), since a main irradiation unit 52 is provided on the downstream side of the carriage 31 in the transport direction, it is possible to sufficiently cure the upper image even though the provisional irradiation units 51*a* and 51*b* are not extended on the downstream side in the transport direction. In addition, the printer 1 may not have the main irradiation unit 52.

In addition, hitherto, dots have been set to be formed at ¼ of the pixel region aligning in the movement direction in one pass, and to be formed in the entire region which is aligned in the movement direction in four passes, however, it is not limited to this. For example, one pixel region may be overlappingly printed with dots with the same color. That is, dots may be formed in the entire region aligning in the movement direction in each pass, and may be formed such that four dots with the same color are overlappingly formed in one pixel region in four passes. By doing that, it is possible to improve filling in of the medium by the UV ink, and to increase the density of the image.

Printing Method According to the Embodiment

Second Embodiment

Figure 6A:
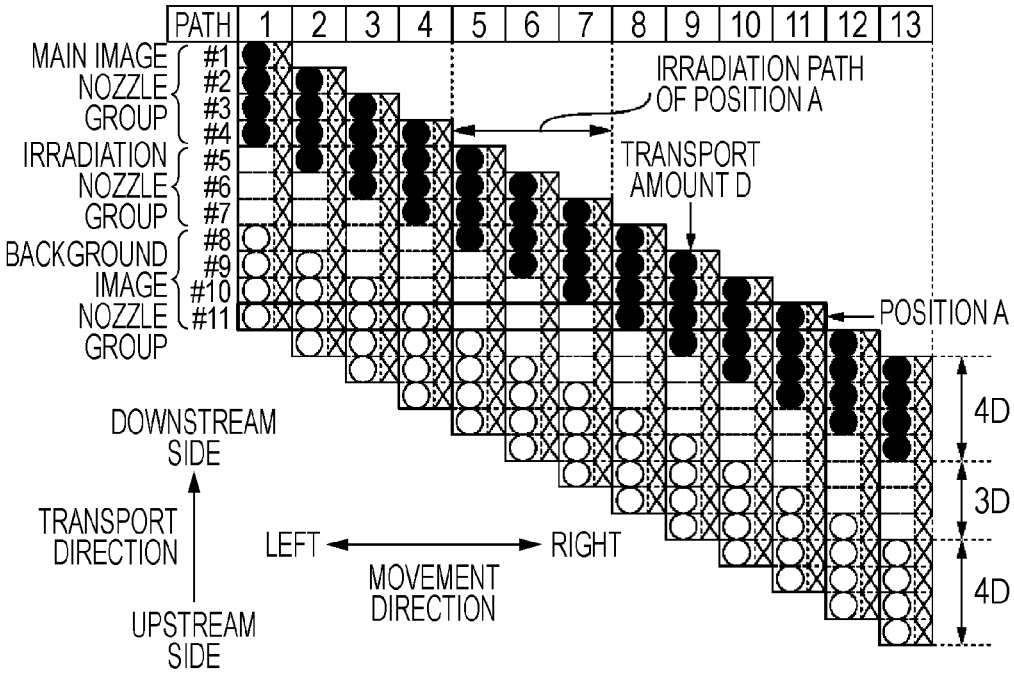
FIG. 6A is a diagram which describes a printing method of a second embodiment.
Figure 6B:
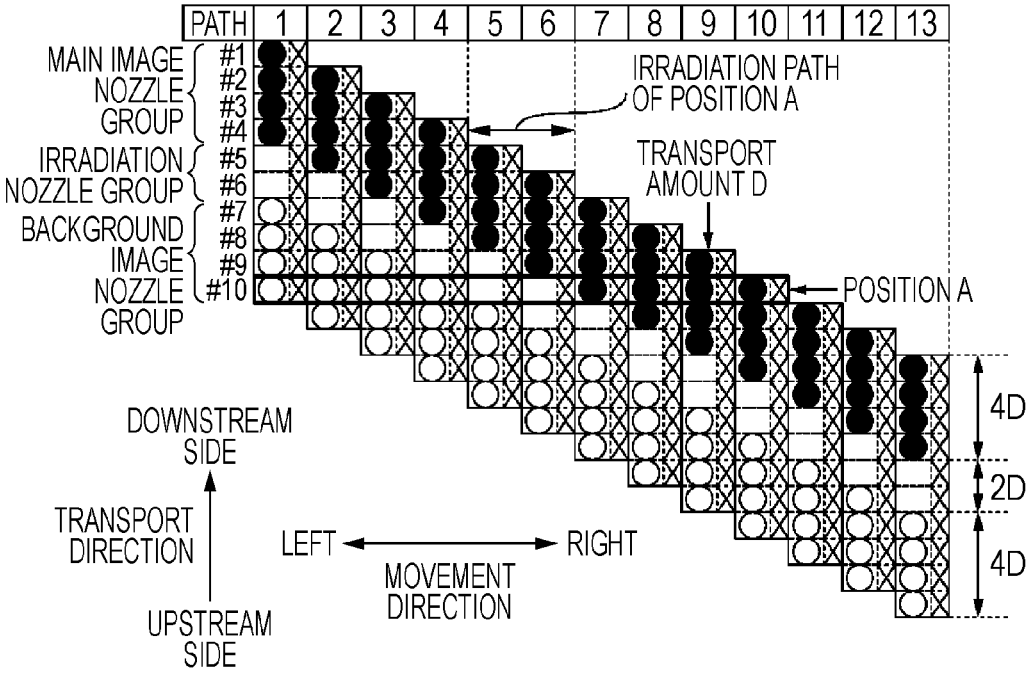
FIG. 6B is a diagram which describes a printing method of the second embodiment.
Figure 6C:
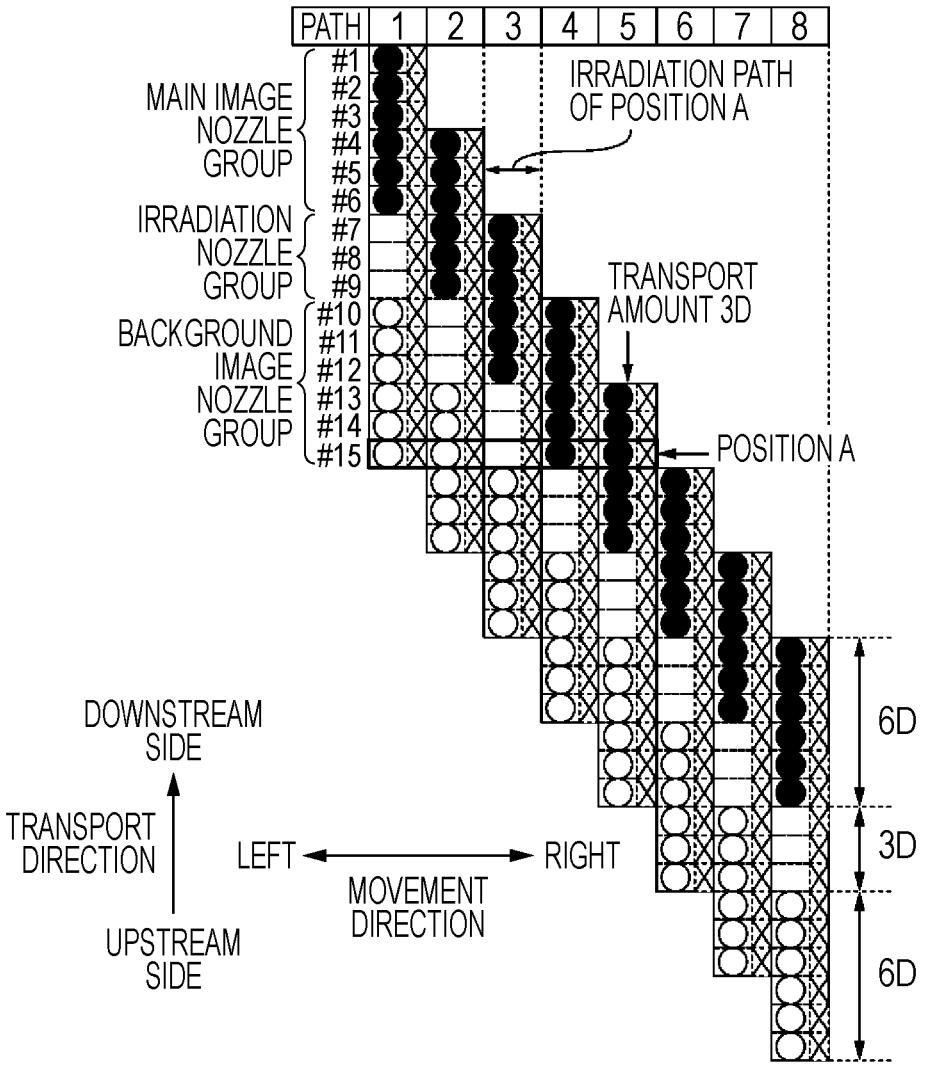
FIG. 6C is a diagram which describes a printing method of the second embodiment.

FIGS. 6A to 6C are diagrams which describe a printing method according to a second embodiment. In the figures, the front side printing mode is exemplified to be described. In the above described first embodiment (FIGS. 5A and 5B), only a case where the length of the irradiation nozzle group in the transport direction is equal to the length of the main image nozzle group in the transport direction, and the length of the background image nozzle group in the transport direction was shown, and the length of the irradiation nozzle group in the transport direction is fixed.

However, the irradiation amount of the UV light to be radiated to the underlying image between the ending of printing of the underlying image with respect to a predetermined region of a medium and starting of printing of the upper image varies, according to the properties of the UV ink, the desired image quality, the curing degree of the underlying image which is necessary before overlapping the upper image, or the like.

Therefore, in the second embodiment, the irradiation amount of the UV light to be radiated to the underlying image between the ending of printing of the underlying image with respect to a predetermined region of a medium and overlapping printing of the upper image is set to be variable. That is, the number of passes in which a predetermined region (underlying image) of the medium faces the irradiation nozzle group after printing of the underlying image is set to be variable.

For this reason, in the second embodiment, the ratio of the length of the irradiation nozzle group (non-ejection region) in the transport direction to the length of the main image nozzle group (first nozzle group) in the transport direction, and the ratio of the length of the irradiation nozzle group in the transport direction to the length of the background image nozzle group (second nozzle group) in the transport direction are set to be variable. In other words, the ratio of the number of the nozzles which belong to the irradiation nozzle group to the number of nozzles which belong to the main image nozzle group, and to the number of nozzles which belong to the background image nozzle group is set to be variable.

For example, when the irradiation amount of the UV light which should be radiated to the underlying image before overlappingly printing the upper image is large, as shown in FIGS. 5A and 5B in the above described first embodiment, the ratio of the length of the irradiation nozzle group in the transport direction (4D) to the length of the main image nozzle group and the background image nozzle group in each transport direction (4D) is set to 1 (=4D/4D). In this manner, it is possible for a predetermined region of the medium to face the irradiation nozzle group after printing the underlying image throughout the same number of passes as that of the passes printing each image, and to irradiate the underlying image with a large amount of the UV light before overlappingly printing the upper image.

On the other hand, when the irradiation amount of the UV light which should be radiated to the underlying image before overlappingly printing the upper image is small, as shown in FIG. 6A, the ratio of the length (3D) of the irradiation nozzle group in the transport direction ¾ (=3D/4D) to the length of the main image nozzle group and the background image nozzle group in each transport direction (4D) may be set to be smaller than 1.

In this case, the background image is printed at the position A on the medium in the transport direction in passes 1 to 4, the UV light is radiated to the background image by the provisional irradiation unit 51*a* in the subsequent passes 5 to 7, and the main image is printed on the background image in the subsequent passes 8 to 11. That is, in FIG. 6A, compared to FIGS. 5A and 5B described above, the number of passes in which a predetermined region of the medium faces the irradiation nozzle group after printing the underlying image is reduced to 3 passes from 4 passes, and the irradiation amount of the UV light to be radiated to the underling image before overlappingly printing the upper image is reduced.

In addition, when the irradiation amount of the UV light to be radiated to the underlying image before overlappingly printing the upper image is further reduced, as shown in FIG. 6B, the ratio of the length (2D) of the irradiation nozzle group in the transport direction ½ (=2D/4D) to the length of the main image nozzle group and the background image nozzle group in each transport direction (4D) may be set to be further smaller than the ratio (¾) in FIG. 6A. In this case, the number of passes in which a predetermined region of the medium faces the irradiation nozzle group after printing the underlying image becomes 2 passes, and the irradiation amount of the UV light to be radiated to the underling image before overlappingly printing the upper image is further reduced.

In this manner, when it is necessary to increase the irradiation amount of the UV light to be radiated to the underlying image before overlappingly printing the upper image, the ratio of the length of the irradiation nozzle group in the transport direction to the length of the main image nozzle group and the background image nozzle group in each transport direction is set to be large, and when it is desired to reduce the irradiation amount of the UV light to be radiated to the underlying image, the ratio is set to be small.

The longer the length of the irradiation nozzle group in the transport direction, the larger the number of the nozzles which do not eject ink, and the length of the nozzle group which prints the image in the transport direction becomes short, accordingly, the printing time becomes longer. For this reason, as in the second embodiment, it is possible to reduce the printing time while suppressing the deterioration in image quality by shortening the length of the irradiation nozzle group in the transport direction according to the irradiation amount of the UV light which is necessary for curing the underlying image before overlappingly printing the main image. In addition, it is not necessary to make the length of the nozzle column in the transport direction long in order to make the length of the nozzle group printing the image be the predetermined length.

However, as described above, the length of the main image nozzle groups in the transport direction, the length of the background image nozzle groups in the transport direction, and the length of the irradiation nozzle groups (non-ejection region) in the transport direction are set to the length of integral multiple of the medium transport amount in one transport operation. In this manner, it is possible to make the number of passes printing each image, and the number of passes in which a predetermined region of the medium faces the irradiation nozzle group be constant.

Hitherto, the length of the main image nozzle group and the background image nozzle group in the transport direction is set to 4D, and the medium transport amount is set to D, however, they are not limited to these. For example, as shown in FIG. 6C, the length of the main image nozzle group and the background image nozzle group in the transport direction may be set to 6D, the length of the irradiation nozzle group in the transport direction may be set to 3D, and the medium transport amount may be set to 3D. In this case, the main image and the background image in a predetermined region of the medium are printed in 2 passes, respectively, and the pass in which the provisional irradiation units 51*a* and 51*b* irradiate the underlying image with the UV light before the upper image is overlappingly printed becomes one pass.

Printing Method of the Embodiment

Third Embodiment

The longer the length of the irradiation nozzle group in the transport direction (the larger the number of nozzles belonging to the irradiation nozzle group), the larger the number of passes in which a predetermined region of the medium faces the irradiation nozzle group after printing the underlying image, and it is possible to increase the irradiation amount of the UV light to be radiated to the underlying image before the upper image is overlapped. However, the printing time becomes long.

Here, according to the third embodiment, when the length of the irradiation nozzle group in the transport direction is shortened (when the number of nozzles belonging to the irradiation nozzle group is reduced), the irradiation intensity ($mW/cm^2$) of the UV light from the provisional irradiation units 51*a* and 51*b* is set to be strong, instead of decreasing the number of passes in which a predetermined region of the medium faces the provisional irradiation units 51*a* and 51*b* after printing the underlying image.

That is, the irradiation intensity of the UV light from the provisional irradiation units 51*a* and 51*b* is set to be strong, when the ratio of the length of the irradiation nozzle group in the transport direction to the length of the main image nozzle group in the transport direction, and the ratio of the length of the irradiation nozzle group in the transport direction to the length of the background image nozzle group in the transport direction has a small value (the second value) compared to a case where a value of the ratio is a certain value (the first value).

By doing that, it is possible to make the irradiation amount of the UV light (irradiation intensity of UV light×irradiation time) to be radiated to the underlying image large before overlappingly printing the upper image large, even though the length of the irradiation nozzle group in the transport direction is shortened. Accordingly, it is possible to overlappingly print the upper image in a state where the underlying image is sufficiently cured, and to reduce the printing time.

In addition, when the irradiation intensity of the UV light from the provisional irradiation units 51*a* and 51*b* is strong, a large current may be applied to the provisional irradiation units 51*a* and 51*b*. In addition, the irradiation intensity of the provisional irradiation units 51*a* and 51*b* in the entire region may be strengthened, and the irradiation intensity of the provisional irradiation units 51*a* and 51*b* only at a portion aligning with the irradiation nozzle group in the movement direction may be strengthened.

Figure 7:
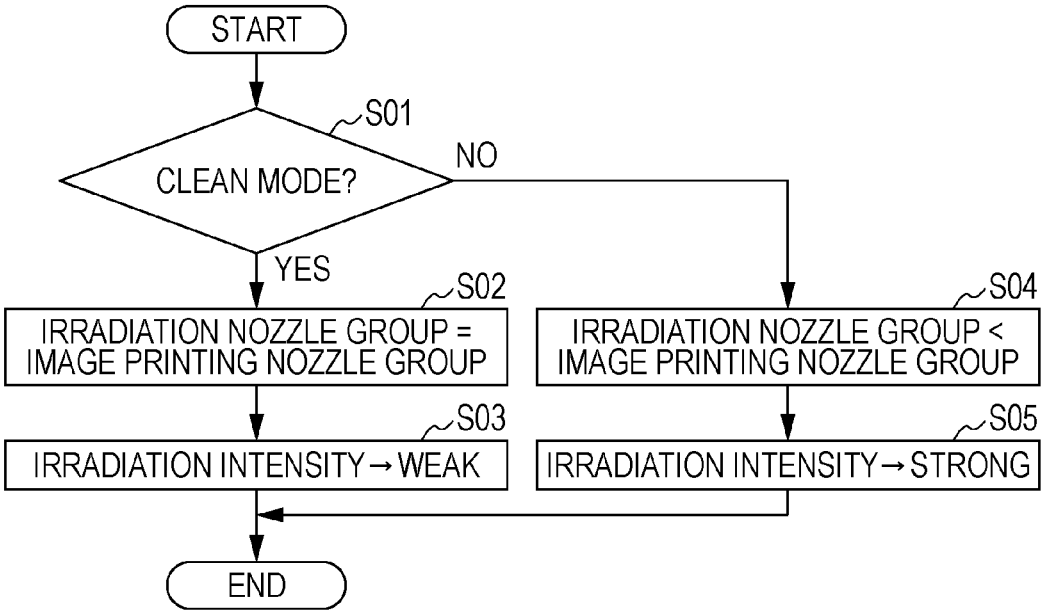
FIG. 7 is an example of a flow which determines the length of an irradiation nozzle group in the transport direction.

FIG. 7 is an example of a flow determining the length of the irradiation nozzle group in the transport direction. It is possible to reliably cure the underlying image before the upper image is overlapped when the length of the irradiation nozzle group in the transport direction is long, even when the irradiation intensity of the UV light from the provisional irradiation units 51*a* and 51*b* is set to be strong, instead of making the length of the irradiation nozzle group in the transport direction short.

Therefore, when a "clear mode" is set by a user (S01→Y), for example, the controller 10 of the printer 1 sets a printing method to be executed, in which the length of the irradiation nozzle group in the transport direction is equal to the length of the image printing nozzle group (main image nozzle group and background image nozzle group) in the transport direction (FIGS. 5A and 5B) (S02). On the other hand, when a "fast mode" is set by a user (S01→N), the controller 10 sets so that a printing method (FIGS. 6A to 6C) is to be executed, in which the length of the irradiation nozzle group in the transport direction is shorter than that of the image printing nozzle group in the transport direction (S04).

In addition, when it is the clear mode, the controller 10 sets the irradiation intensity of the UV light from the provisional irradiation units 51*a* and 51*b* to be weak compared to a case where it is the fast mode (S03), and on the contrary, when it is the clear mode, sets the irradiation intensity of the UV light from the provisional irradiation units 51*a* and 51*b* to be strong, compared to a case where it is the fast mode (S05).

In this manner, when it is the clear mode, it is possible to increase the number of passes in which the underlying image faces the irradiation nozzle group before overlappingly printing the upper image, to overlap the upper image in a state where the underlying image is sufficiently cured, and to suppress the deterioration of the image quality of the printed image. On the other hand, when it is the fast mode, it is possible to reduce the printing time, and to prevent the upper image from being overlapped with the underlying image in a state where the underlying image is not sufficiently cured, since the irradiation intensity of the UV light from the provisional irradiation units 51*a* and 51*b* is strong.

In addition, the determination on the length of the irradiation nozzle group in the transport direction is not limited only by the printing mode. Since it is easy to express glossiness on an image when the UV light is radiated for a long time with a relatively low irradiation intensity, for example, when it is desired to express glossiness on the image, the length of the irradiation nozzle group in the transport direction may be set to be long, and when it is not desired to express glossiness on the image, the length of the irradiation nozzle group in the transport direction may be set to be short. That is, the length of the irradiation nozzle group in the transport direction may be determined according to the desired image quality.

MODIFICATION EXAMPLES

Modification Example 1

In the above described embodiment, a printing method (FIGS. 5A and 5B, FIGS. 6A to 6C) has been exemplified in which each raster line configuring the main image and the background image are respectively printed in a plurality of passes including the transport operation therebetween, however, it is not limited to this. For example, it may be a printing method in which each raster line configuring the main image and the background image is respectively printed in one pass, that is, a printing method (a so-called band printing) in which an image printed in one pass is aligned in the transport direction, and a raster line in another pass is not printed between raster lines which are printed in certain passes.

In the band printing, as shown in FIGS. 4A and 4B, it is assumed that half of the nozzles (Nos. 5 to 8) on the upstream side of the white nozzle column W in the transport direction are the background image nozzle group, half of the nozzles (Nos. 1 to 4) on the downstream side of the color nozzle column Co in the transport direction are the main image nozzle group, and the medium transport amount is the length of half of the nozzle column (4D). By doing that, the background image is printed at a predetermined region of the medium in a certain pass, and then, the main image is printed on the background image at a predetermined region of the medium in the subsequent pass, accordingly, the main image is overlappingly printed in a state where the background image is not sufficiently cured.

Therefore, even in band printing, it is preferable to provide the irradiation nozzle group (non-ejection region) between the main image nozzle group and the background image nozzle group. By doing that, it is possible to overlappingly print the upper image in a state where the underlying image is sufficiently cured.

Modification Example 2

In the above described embodiment, in the white nozzle column W and the color nozzle column Co, the nozzles are aligned with a predetermined gap D in the transport direction. That is, it is set such that passes only for radiating the UV light by the provisional irradiation units 51*a* and 51*b* with respect to a predetermined region of the medium after printing the underlying image are provided, by not ejecting ink from nozzles (irradiation nozzle group) which are positioned between the main image nozzle group and the background image nozzle group, however, it is not limited to this.

For example, a region where nozzles are not present (non-ejection region) may be provided between the main image nozzle group and the background image nozzle group. In this case, since a predetermined region of the medium faces the non-ejection region (a region where nozzles are not present) after printing the underlying image, it is possible to provide passes only for radiating the UV light by the provisional irradiation units 51*a* and 51*b* with respect to a predetermined region of the medium after printing the underlying image. Accordingly, it is possible to overlappingly print the upper image in a state where the underlying image is sufficiently cured.

Modification Example 3

In the above described embodiment, the background image is printed only with white ink, however, it is not limited to this. Since the color tone of white is different depending on the type of white ink, the color of the white ink as is becomes the color of the background image when performing printing with the white ink only. In addition, there may be a case where a background image with a slight chromatic color is desired, not the pure white color. Therefore, it is preferable to print a background image with a desired white color (background image with an adjusted white color), by appropriately using a small amount of four colors of ink (YMCK) along with the white ink. In addition, on the contrary, it is preferable to remove the slight color in the white ink by mixing four colors of ink in the white ink.

In addition, the color of the background image is not limited to white, and it is possible to print the background image with color ink other than the white ink (for example, metallic ink). Further, printing of the main image is not limited to the four colors of ink (YMCK), and the main image may be printed by mixing the white ink to the four colors of ink.

Modification Example 4

In the above described embodiment, the length of the main image nozzle group in the transport direction is equal to the length of the background image nozzle group in the transport direction, however, it is not limited to this. For example, since it is not necessary to print the background image with high resolution as much as the main image (no need to increase the print resolution), the length of the background image nozzle group in the transport direction may be shorter than that of the main image nozzle group in the transport direction (that is, the number of nozzles belonging to the background image nozzle group may be reduced). Instead, in order to make filling in of the medium by the white ink good, it is preferable to make the ink amount ejected in one time from the background image nozzle group be larger than the ink amount ejected in one time from the main image nozzle group.

Modification Example 5

In the above described embodiment, both the front side printing mode and the rear side printing mode are executed, however, it is not limited to this, and only one mode thereof may be executed.

In addition, in the above described embodiment, two types of images of the main image and the background image are overlapped with each other, however, it is not limited to this. For example, three types of images (main image, background image, and coating image) may be overlapped with each other. In this case, it is preferable that the nozzle column is divided into five, an irradiation nozzle group is provided between the nozzle group printing the underlying image and a nozzle group printing the center image, and an irradiation nozzle group is provided between the nozzle group printing the center image and the nozzle group printing the upper image.

Other Embodiments

In the above described embodiment, mainly the image forming device has been described, however, a disclosure of the method of image forming, or the like is included. In addition, the above described embodiment is to facilitate the understanding of the invention, and is not to be construed as limiting the invention. The invention may be changed and modified without departing from the scope of the invention, and it goes without saying that the equivalents thereof are included in the invention as a matter of course.

Regarding Ink

In the above described embodiment, as photo-curable ink to be ejected from the head, UV-curable ink has been exemplified, however, it is not limited to this. For example, it may be ink cured by being irradiated with visible light, and in this case, the light irradiation unit is to radiate visible light.

Regarding Printer

In the above described embodiment, a printer has been exemplified in which the ejection operation which ejects ink from the head while moving in the movement direction, and the transport operation which transports the medium in the transport direction are repeated, however, it is not limited to this. For example, it may be a printer in which an image is formed by repeating an operation of forming the image while moving the head in the medium transport direction with respect to continuous-feed paper which is transported in a printing region, and an operation of moving the head in the paper width direction, and a portion of the medium which is not printed yet is transported to the printing region, thereafter.

Regarding White Color

The "color white" in the specification includes colors which are referred to as a white in general societal terms, as a so-called "whitish color", without being limited to white in the strict sense as the surface color of an object which reflects all of wavelengths of the visible light, 100%. The "color white" is a color of which the marking in Lab system is a circumference of radius 20 on the a* b* plane, and the inside thereof, and is color which is in a hue range expressed when L* is 70 or more, for example, when (1) color measurement mode using the Eye-One Pro made by SDG K. K. is spot colorimeter, light source is D50, backing is Black, and color of the printing medium is measured using a transparent film, color of which marking in the Lab system is a circumference of radius 20 on the a* b* plane, and is inside thereof, and is a color which is in the hue range expressed when L* is 70 or more, when (2) measurement mode using the colorimeter CM 2022 made by Minolta Co., Ltd. is D502° of a field of vision, and SCF mode, and the color thereof is measured using a white background color, a marking in Lab system is on the circumferential of radius 20 and inside thereof on an a* b* plane, and is in a range of color hue, or (3) the color of ink used as a background of an image as described in JP-A-2004-306591, and it is not limited to pure white as long as it is used as the background.

What is claimed is:

1. An image forming device comprising:

(A) a first nozzle group in which nozzles which eject a first photo-curable ink are aligned in a predetermined direction;

(B) a second nozzle group in which nozzles which eject a second photo-curable ink are aligned in the predetermined direction, and are arranged by being deviated from the first nozzle group on one side in the predetermined direction;

(C) a light irradiation unit which cures the photo-curable ink by radiating light to the photo-curable ink, and is arranged by being extended at least in the predetermined direction, by being stretched to an end portion on one side of the second nozzle group in the predetermined direction from an end portion of the other side of the first nozzle group in the predetermined direction; and (D) a control unit which causes an ejection operation in which the photo-curable ink is ejected from the nozzle while moving the nozzle groups and the light irradiation unit in a movement direction which intersects the predetermined direction, and a transport operation which relatively moves the nozzle group and the light irradiation unit, and the medium in the predetermined direction to be repeatedly executed, and forms a main image which is formed using the first photo-curable ink, and a background image which is overlappingly formed using the second photo-curable ink, in a state where a non-ejection area that includes an irradiation nozzle group in which ink is not ejected is provided between the first nozzle group and the second nozzle group in the predetermined direction so as to contact both the first and second nozzles groups, wherein a length of the non-ejection area in the predetermined direction is longer than a length of a nozzle pitch of the nozzles.

2. The image forming device according to claim 1, wherein dot columns which configure the main image, and are aligned along the movement direction are formed by the plurality of ejection operations including the transport operation therebetween, and wherein dot columns which configure the background image, and are aligned along the movement direction are formed by the plurality of ejection operations including the transport operation therebetween.

3. The image forming device according to claim 1, wherein a ratio of the length of the non-ejection area in the predetermined direction to the length of the first nozzle group in the predetermined direction, and a ratio of the length of the non-ejection area in the predetermined direction to the length of the second nozzle group in the predetermined direction are changeable.

4. The image forming device according to claim 3, wherein when the ratio is a second value which is smaller than a first value compared to a case where the ratio is the first value, an irradiation intensity of light from the light irradiation unit is strong.

5. The image forming device according to claim 1, wherein the length of the first nozzle group in the predetermined direction, the length of the second nozzle group in the predetermined direction, and the length of the non-ejection area in the predetermined direction are the lengths of integral multiple of an amount the medium is transported in the predetermined direction during the transport operation.

6. The image forming device according to claim 1, wherein the non-ejection area includes a nozzle in which ink is not ejected.

7. A method of image forming comprising:

forming an image on a recording medium using an image forming device, the device includes:

(A) a first nozzle group in which nozzles which eject a first photo-curable ink are aligned in a predetermined direction;

(B) a second nozzle group in which nozzles which eject a second photo-curable ink are aligned in the predetermined direction, and are arranged by being deviated from the first nozzle group on one side in the predetermined direction;

(C) a light irradiation unit which cures the photo-curable ink by radiating light to the photo-curable ink, and is arranged by being extended at least in the predetermined direction, by being stretched to an end portion on one side of the second nozzle group in the predetermined direction from an end portion of the other side of the first nozzle group in the predetermined direction; and (D) a control unit which causes an ejection operation in which the photo-curable ink is ejected from the nozzle while moving the nozzle groups and the light irradiation unit in a movement direction which intersects the predetermined direction, and a transport operation which relatively moves the nozzle group and the light irradiation unit, and the medium in the predetermined direction to be repeatedly executed, and forms a main image which is formed using the first photo-curable ink, and a background image which is overlappingly formed using the second photo-curable ink, in a state where a non-ejection area that includes an irradiation nozzle group in which ink is not ejected is provided between the first nozzle group and the second nozzle group in the predetermined direction so as to contact both the first and second nozzles groups, wherein a length of the non-ejection area in the predetermined direction is longer than a length of a nozzle pitch of the nozzles.

8. The image forming method according to claim 6, wherein the non-ejection area includes a nozzle in which ink is not ejected.

9. An image forming device comprising:

(A) a first nozzle group in which nozzles which eject a first photo-curable ink are aligned in a predetermined direction;

(B) a second nozzle group in which nozzles which eject a second photo-curable ink are aligned in the predetermined direction, and are arranged by being deviated from the first nozzle group on one side in the predetermined direction;

(C) a light irradiation unit which cures the photo-curable ink by radiating light to the photo-curable ink, and is arranged by being extended at least in the predetermined direction, by being stretched to an end portion on one side of the second nozzle group in the predetermined direction from an end portion of the other side of the first nozzle group in the predetermined direction; and (D) a control unit which causes an ejection operation in which the photo-curable ink is ejected from the nozzle while moving the nozzle groups and the light irradiation unit in a movement direction which intersects the predetermined direction, and a transport operation which relatively moves the nozzle group and the light irradiation unit, and the medium in the predetermined direction to be repeatedly executed, and forms a main image which is formed using the first photo-curable ink, and a background image which is overlappingly formed using the second photo-curable ink, in a state where a non-ejection area that includes an irradiation nozzle group in which ink is not ejected is provided between the first nozzle group and the second nozzle group in the predetermined direction so as to contact both the first and second nozzles groups, wherein a ratio of the length of the non-ejection area in the predetermined direction to the length of the first nozzle group in the predetermined direction, and a ratio of the length of the non-ejection area in the predetermined direction to the length of the second nozzle group in the predetermined direction are changeable.

* * * * *